US012433453B2

(12) United States Patent
Yang et al.

(10) Patent No.: US 12,433,453 B2
(45) **Date of Patent: *Oct. 7, 2025**

(54) SYSTEMS AND METHODS FOR ACCESSIBLY POSITIONED SANITIZING MATERIALS

(71) Applicant: simplehuman, LLC, Torrance, CA (US)

(72) Inventors: Frank Yang, Rancho Palos Verdes, CA (US); Joseph Sandor, Newport Beach, CA (US); Myk Wayne Lum, Irvine, CA (US); Adam C. Wade, Rancho Santa Margarita, CA (US)

(73) Assignee: simplehuman, LLC, Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/586,330

(22) Filed: Feb. 23, 2024

(65) Prior Publication Data

US 2024/0188762 A1 Jun. 13, 2024

Related U.S. Application Data

(63) Continuation of application No. 17/644,314, filed on Dec. 14, 2021, now Pat. No. 11,910,969.

(60) Provisional application No. 63/125,927, filed on Dec. 15, 2020.

(51) Int. Cl.
*A47K 5/12* (2006.01)
*A47K 10/38* (2006.01)

(52) U.S. Cl.
CPC ..... *A47K 5/1202* (2013.01); *A47K 10/38* (2013.01); *A47K 2010/389* (2013.01)

(58) Field of Classification Search
USPC ..... 222/192
See application file for complete search history.

(56) References Cited

U.S. PATENT DOCUMENTS

| | | | |
|---|---|---|---|
| 1,255,772 | A | 2/1918 | Miller |
| 1,582,645 | A | 4/1926 | Findley |
| 4,436,224 | A | 3/1984 | Mcinerny |

(Continued)

FOREIGN PATENT DOCUMENTS

| | | |
|---|---|---|
| CA | 225686 | 11/2024 |
| CN | 302342514 | 3/2013 |

(Continued)

OTHER PUBLICATIONS

Extended Search Report in corresponding European Patent Application No. 21214362.2, dated May 19, 2022, in 6 pages.

(Continued)

*Primary Examiner* — Paul R Durand
*Assistant Examiner* — Michael J. Melaragno
(74) *Attorney, Agent, or Firm* — Knobbe Martens Olson & Bear LLP

(57) ABSTRACT

Accessibly positioned sanitizing materials can include paper towels and sanitizing sprays. A paper towel holder with a central support to hold a roll of paper towels can allow spinning dispensing of paper towels. The central support can also function separately as a removable disinfectant sprayer, enabling a user to carry and store paper towels and disinfecting solution in the same location, and providing a disinfecting sprayer nearby when paper towels are used to clean a surface. The structure described can also house other fluids for spraying.

21 Claims, 11 Drawing Sheets

(56) References Cited

U.S. PATENT DOCUMENTS

| | | | |
|---|---|---|---|
| D306,809 | S | 3/1990 | Joseph |
| 5,277,340 | A | 1/1994 | Van Brocklin |
| 5,297,750 | A | 3/1994 | Hunt |
| 5,305,874 | A | 4/1994 | McLaughlin |
| D376,910 | S | 12/1996 | Tuchman |
| 5,671,872 | A | 9/1997 | Daniels |
| 5,819,989 | A | 10/1998 | Saraceni |
| D432,828 | S | 10/2000 | Snell |
| 6,138,874 | A | 10/2000 | Audrey |
| 6,216,920 | B1 | 4/2001 | Baggett |
| 6,431,405 | B2 | 8/2002 | Irwin |
| D479,072 | S | 9/2003 | Duncan et al. |
| 6,644,563 | B2 | 11/2003 | Presson |
| D499,915 | S | 12/2004 | Snell |
| D520,278 | S | 5/2006 | Mariano |
| D522,292 | S | 6/2006 | Goodman |
| D522,293 | S | 6/2006 | Yang |
| D523,268 | S | 6/2006 | Goodman |
| D523,672 | S | 6/2006 | Yang |
| D530,549 | S | 10/2006 | Yang |
| D531,256 | S | 10/2006 | Larsen et al. |
| 7,140,573 | B1 | 11/2006 | Jerstroem |
| D545,599 | S | 7/2007 | Yu |
| D548,504 | S | 8/2007 | Yang |
| D555,954 | S | 11/2007 | Yang |
| D562,042 | S | 2/2008 | Shek |
| D563,130 | S | 3/2008 | Griffith |
| D575,157 | S | 8/2008 | Jaketic |
| 7,556,179 | B2 | 7/2009 | Yang et al. |
| D609,949 | S | 2/2010 | Yang |
| D610,382 | S | 2/2010 | Yang |
| D617,653 | S | 6/2010 | Thumerel et al. |
| 7,743,947 | B2 | 6/2010 | Flasch |
| D626,006 | S | 10/2010 | Duquet |
| D635,808 | S | 4/2011 | Gordon |
| D647,407 | S | 10/2011 | Toh et al. |
| D647,806 | S | 11/2011 | Toh et al. |
| 8,096,445 | B2 | 1/2012 | Yang et al. |
| D656,840 | S | 4/2012 | Tacconi et al. |
| D672,590 | S | 12/2012 | Yang |
| 8,371,479 | B2 | 2/2013 | Luft |
| D761,039 | S | 7/2016 | Locker |
| D778,634 | S | 2/2017 | Locker |
| 10,004,374 | B2 | 6/2018 | Schildmeier |
| 10,076,216 | B2 | 9/2018 | Yang et al. |
| D837,064 | S | 1/2019 | Partrat |
| D843,844 | S | 3/2019 | Song |
| 10,527,224 | B1 | 1/2020 | Park |
| D878,077 | S | 3/2020 | Goodman |
| D880,891 | S | 4/2020 | Zhou |
| 10,806,305 | B2 | 10/2020 | Yang et al. |
| D916,489 | S | 4/2021 | Stefani |
| D935,215 | S | 11/2021 | Liang |
| D935,216 | S | 11/2021 | Liang |
| D964,772 | S | 9/2022 | He |
| D966,006 | S | 10/2022 | Gao |
| D1,002,228 | S | 10/2023 | Xu |
| D1,014,280 | S | 2/2024 | Liston et al. |
| 11,910,969 | B2 | 2/2024 | Yang et al. |
| D1,028,560 | S | 5/2024 | Kamenstein et al. |
| 12,178,363 | B2 | 12/2024 | Yang et al. |
| D1,061,076 | S | 2/2025 | Yang et al. |
| D1,061,258 | S | 2/2025 | Yang et al. |
| 2002/0079380 | A1 | 6/2002 | Presson |
| 2007/0034650 | A1 | 2/2007 | Pulch |
| 2007/0176043 | A1 | 8/2007 | Yu |
| 2007/0194168 | A1 | 8/2007 | Yang |
| 2007/0262191 | A1 | 11/2007 | Amron |
| 2008/0011331 | A1 | 1/2008 | Flasch |
| 2009/0101665 | A1 | 4/2009 | Mulhern |
| 2010/0301136 | A1 | 12/2010 | Scott |
| 2011/0315715 | A1 | 12/2011 | Ophardt |
| 2015/0196173 | A1 | 7/2015 | Hoefte et al. |
| 2015/0366416 | A1 | 12/2015 | Hoefte et al. |
| 2017/0266678 | A1 | 9/2017 | Harrington |
| 2019/0329276 | A1 | 10/2019 | Simard |
| 2022/0183509 | A1 | 6/2022 | Yang et al. |
| 2022/0225845 | A1 | 7/2022 | Steinmetz et al. |

FOREIGN PATENT DOCUMENTS

| | | | |
|---|---|---|---|
| CN | 307157365 | | 3/2022 |
| CN | 307817244 | | 1/2023 |
| CN | 307984709 | | 4/2023 |
| DE | 102020008002 | A1 | 9/2021 |
| EM | 002069179-0001 | | 10/2012 |
| EM | 015042989-0001 | | 2/2024 |
| EP | 1749581 | A1 | 2/2007 |
| EP | 4014824 | A1 | 6/2022 |
| GB | 9002069179-0001 | | 7/2012 |
| GB | 6330351 | | 12/2023 |
| JP | 2000-309405 | A | 9/2021 |
| TW | 161928-0001 | | 7/2014 |
| WO | WO2015195604 | | 12/2015 |

OTHER PUBLICATIONS

Canadian Exam Report in corresponding CA Application No. 226363 dated Dec. 11, 2024.

Office Action in corresponding EP Patent Application No. 21214362.2, dated Jun. 4, 2024, in 10 pages.

Extended Search Report in corresponding European Patent Application No. 23179179.9, dated Nov. 20, 2023, in 7 pages.

Manduoye 2 in 1 Paper Towel Holder with Spray Bottle, posted Aug. 28, 2023 [retrieved Feb. 26, 2024]. Retrieved from internet, https://www.amazon.com/Manduoye-One-Handed-Operation-Weighted-Countertop/dp/BOCGRG51YD/ (Year: 2023).

Paper towel pump, posted date not available [retrieved Feb. 26, 2024]. Retrieved from internet, https://www.simplehuman.com/ products/paper-towel-pump (Year: 2024).

Paper Towel Holder with Spray Bottle, posted Dec. 19, 2023 [retrieved Feb. 26, 2024]. Retrieved from internet, https://www.amazon.com/ Stainless-Countertop-One-Handed-Operation-Kitchen/dp/B00PW84SSU/ (Year: 2023).

Simplehuman website, paper towel pump, Feb. 18, 23, https://www.simplehuman.com/products/paper-towel-pump (Year: 2023).

Simplehuman Paper Towel and Spray Pump White, posted date not available [retrieved Feb. 26, 2024]. Retrieved from internet, https://www.containerstore.com/s/kitchen/kitchen-cleaning/si mplehu man-paper-towel-pum p/12d?productId= 11019799 (Year: 2024).

Simplehuman Standing Paper Towel Holder with Spray Pump, posted date not available [retrieved Feb. 26, 2024]. Retrieved from internet, https://www.amazon.com/simplehuman-Standing-Holder-Brushed-Stainless/dp/BOCJYC69D8/ (Year: 2024).

Simplehuman Paper Towel Pump Review, posted Mar. 6, 2023 [retrieved Mar. 5, 2024]. Retrieved from internet, https:// reviewed.usatoday.com/cleaning/contenUsimplehuman-paper-towel-pump-review (Year: 2023).

SimpleHuman Paper Towel Pump, posted May 26, 2023 [retrieved Mar. 5, 2024]. Retrieved from internet, https://www.youtube.com/shorts/YM4nlqICW-0 (Year: 2023).

SimpleHuman Paper Towel Pump, posted Feb. 1, 2023 [retrieved Mar. 7, 2024]. Retrieved from internet, https://www.tiktok.com/UZTLRuUbA2/ (Year: 2023).

SYSTEMS AND METHODS FOR ACCESSIBLY POSITIONED SANITIZING MATERIALS

PRIORITY, CROSS-REFERENCE AND INCORPORATION

This application is a continuation of U.S. patent application Ser. No. 17/644,314, filed Dec. 14, 2021, which claims the benefit of U.S. Provisional Patent Application No. 63/125,927, filed Dec. 15, 2020. The entire contents of the above-listed application is hereby incorporated into this document by reference and made a part of this specification for all purposes, for all that it contains. Moreover, any and all applications for which a foreign or domestic priority claim is identified in the Application Data Sheet of the present application are hereby incorporated by reference under 37 C.F.R. § 1.57.

BACKGROUND

Field

This disclosure relates generally to dispensers and supports for commonly-accessed items. For example, sanitizing devices and materials such as paper towels and liquid sanitizers can be stored and dispensed in an efficient and convenient manner.

Related Art

Paper towels can be held in place using elongate structures that are inserted into the cardboard tube upon which paper towels are rolled. Liquid sanitizer can be stored in a spray bottle.

SUMMARY

This disclosure includes a description of a system that can store multiple commonly accessed items having very different properties in a combined or common structure. For example, a central rod of a paper towel holder can also store liquid sanitizer and include features for disseminating liquid.

A sanitizer storage and dispensing system can comprise a base and an elongate holder configured to extend through the interior of a tube for holding rolled paper-based cleaning products. The elongate holder can be structurally supported by the base. An elongate receptacle can be configured to hold and dispense liquid sanitizer. The system can be configured to position the receptacle and the holder generally concentrically and/or generally coaxially. The elongate holder can be configured to contain the elongate receptacle. The elongate holder can be configured to removably receive the elongate receptacle. The elongate holder and the elongate receptacle can form part of the same structure. The elongate holder can comprise a hollow supporting tube, the elongate receptacle can comprise an internal, fluid-tight reservoir and a nozzle, and the receptacle can be sized and configured to be positioned at least partly within the supporting tube. The base can be configured to rigidly position the hollow supporting tube perpendicularly to a planar surface to facilitate holding a full roll of paper towels, the elongate receptacle can be configured to disengage from the system for independent use while the hollow supporting tube remains in place for supporting paper towels, and the receptacle can be refillable and configured to allow a user to periodically dispense fluid from the nozzle. The elongate receptacle can comprise: a spray trigger operable to initiate the transfer of fluid from the reservoir and out through the nozzle; a transparent portion configured to allow views of a fill-level state of the reservoir; and a removable lid configured to allow a user to refill or add liquid to the reservoir. The elongate receptacle can comprise a removable attachment (e.g. a catch mechanism) for securing the receptacle to the dispensing system and a release (e.g., a one-handed release) configured to disengage the attachment to allow a user to temporarily remove the receptacle from the base for use.

A paper towel holder and liquid dispensing system can comprise: a tip-resistant base; an elongate rod sized to hold paper towel rolls; and a removable spray tube sized to fit within a paper towel roll while it is being held by the system. The spray tube can comprise a liquid reservoir and a manual dispenser having a nozzle. The removable spray tube can form at least a portion of the elongate rod. The removable spray tube can be sized for insertion into at least a portion of the elongate rod. A releasable securement can be configured to allow the spray tube to connect to the system and disengage in response to a motion by the user. The removable spray tube can comprise a reservoir, a mechanical spray trigger, and a tube connecting the reservoir to the nozzle such that activation of the trigger causes fluid from the reservoir to flow through the tube and spray out the nozzle.

A system for storing and dispensing both solid and fluid cleaning material can comprise a holder configured to extend at least partly within a roll of solid cleaning material and hold the roll during a dispensing action. It can have a sprayer configured to simultaneously extend at least partly within the same roll of solid cleaning material and to contain liquid cleaning material. The system can also be configured to facilitate simultaneous removal or use of the sprayer with one hand of a user and dispensing of solid cleaning material from the roll with the other hand of the user. The system can further comprise a base configured to rigidly support the holder. The holder can be configured as a hollow tubular structure sized to store and periodically allow a user to access and remove the sprayer. The sprayer can have a reservoir and be configured to reveal an amount of liquid cleaning material remaining within that reservoir. A securement can be configured to secure and/or hold the sprayer within the holder when not in use and quickly release the sprayer upon actuation of a releaser by a user.

BRIEF DESCRIPTION OF THE DRAWINGS

Some of these drawings are schematic, showing some examples of basic parts and concepts. Many different or additional structures, implementations, components, mechanisms, steps, and processes can be used. The claimed inventions should not be limited in any way to anything illustrated in the drawings.

DETAILED DESCRIPTION

Figure 1:
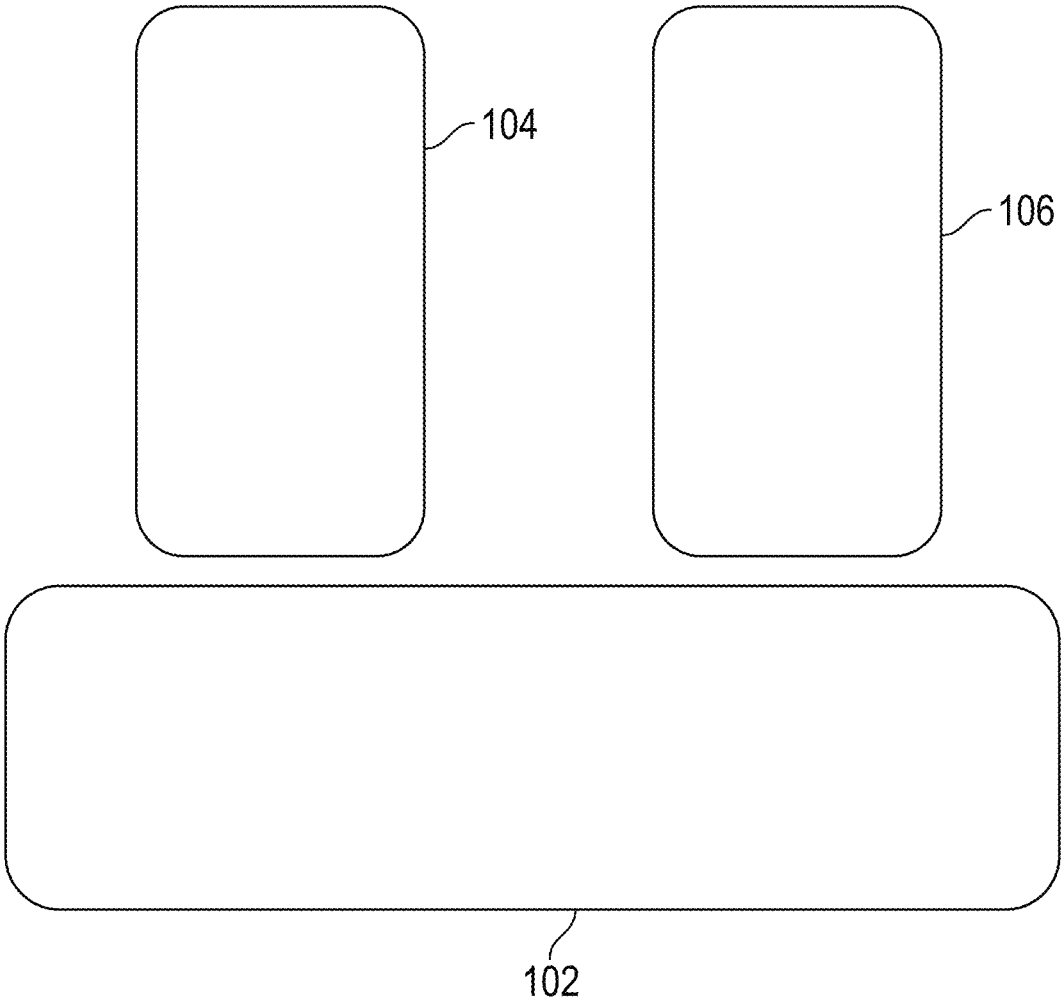
FIG. 1 schematically illustrates a system for storage and dissemination of commonly accessed items.

This specification provides textual descriptions and illustrations of many devices, components, assemblies, and subassemblies. Any structure, material, function, method, or step that is described and/or illustrated in one example can be used by itself or with or instead of any structure, material, function, method or step that is described and/or illustrated in another example or used in this field. The text and drawings merely provide examples and should not be interpreted as limiting or exclusive. No feature disclosed in this application is considered critical or indispensable. The relative sizes and proportions of the components illustrated in the drawings form part of the supporting disclosure of this specification, but should not be considered to limit any claim unless recited in such claim.

A paper towel holder with a central support to hold a roll of paper towels can allow spinning dispensing of paper towels. The central support can also function separately as a removable disinfectant sprayer, enabling a user to carry and store paper towels and disinfecting solution in the same location, and providing a disinfecting sprayer nearby when paper towels are used to clean a surface.

When not in use, a sprayer can be inserted and removably attached (e.g., latched) within an elongate hollow rod (e.g., a vertical pole) of a paper towel holder. A release can be provided, for example a handle or button on top of the sprayer, to separate or release the sprayer from the paper towel holder. A sprayer can have a trigger button that is configured to initiate the spraying of liquid (e.g., disinfecting, cleaning, cooking, moistening, polishing, or other liquid) stored therein onto one or more surfaces, and nearby paper towels may be used to wipe those same surfaces. Additional liquid can be inserted into or refilled in the sprayer when some or all of the contained liquid is used. Various types of liquid can be usefully stored and dispensed in such a manner. In some embodiments, the described structures can be used. For example, one or more of water, sanitizer, cleaner, cleaning agents (detergent, soap), disinfectant, anti-microbial fluid, polishing compounds, window cleaner, cooking sprays, paint, fire starter, etc. can be stored and/or dispensed conveniently. All references to any particular type of liquid or fluid in this disclosure are also intended to include and refer to any or all of the above fluids.

FIG. 1 shows a first dispenser 104, a second dispenser 106, and a support 102. A first dispenser can be connected to the second dispenser 106, or these components can be integrally formed together. The dispensers 104, 106 can both be supported by the support 102. The first dispenser 104 can be configured to support and dispense a roll of paper towels or another cleaning product. The second dispenser 106 can be configured to contain and dispense a liquid cleaning product such as spray sanitizer. The two dispensers 104, 106 can be nested or can comprise a common structure. In some embodiments, as illustrated, the support 102 can be the bottom-most structure or component of the system. In some embodiments, the support 102 can contain, generally surround, generally enclose, and/or generally envelope, a majority, all, or substantially all of the first dispenser 104 and/or the second dispenser 106. The support 102 can be sufficiently stable and heavy to maintain balance and upright orientation when the first and second dispenser 104, 106 are both in place with their weight resting upon the support 102, thereby resisting tipping or tilting of the system when bumped or otherwise contacted by the type of external forces commonly encountered in kitchen or other household counter-top situations. The first and second dispensers 104, 106 can be configured for efficient storage and convenient access. Storage can be arranged concentrically and/or coaxially, such that a first dispenser 104 provides a space within its center for the second dispenser 106. In particular, a first dispenser can comprise a hollow rod for holding paper towels, and a second dispenser and comprise a thin, narrow, and/or elongate rod-shaped spray bottle configured to contain sanitizer. The bottle can be sized and shaped to fit closely within the rod of the first dispenser 104. For example, the bottle can be large enough to provide sufficient sanitizer for repeated, multi-day use in an average household before requiring sanitizer to be replenished, reinserted, and/or refilled; and the bottle can be sufficiently narrow so as not to create resistance or undo friction or contact against the hollow rod of a paper towel roll when the bottle is inserted and/or withdrawn within the hollow rod.

Figure 2:
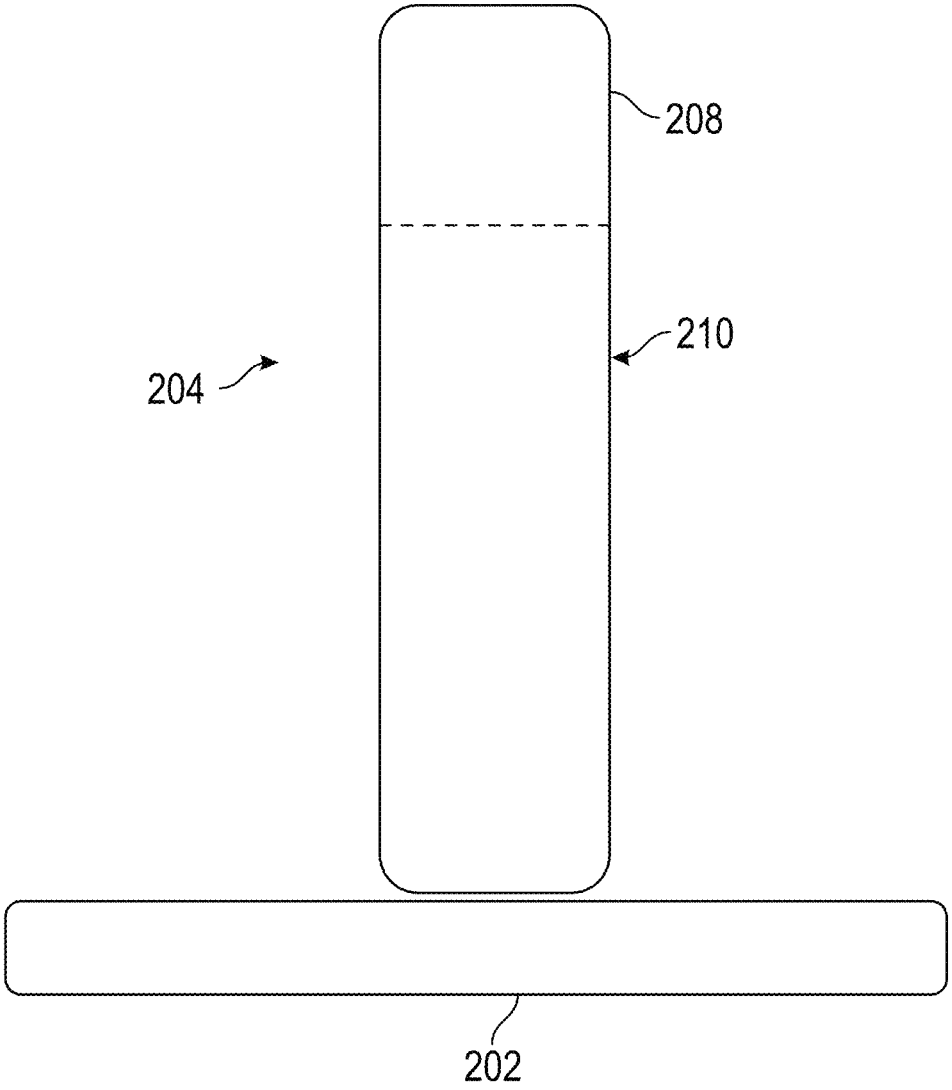
FIG. 2 illustrates a system having a combined dispenser.

FIG. 2 shows an example embodiment of FIG. 1. One or more of the features of FIG. 2 can be used within or instead of any embodiment in this specification. A support 202 is shown at the base of the system. A combined dispenser 204 can rest on the support 202. The combined dispenser 204 can have a first dispenser 208 and a second dispenser to 210. A dashed line is provided on the combined dispenser 204 to indicate that the first dispenser 208 may be on a first portion of a solid object and a second dispenser 210 may be on a second portion of a solid object. However, the first and second dispensers 208, 210 may be different objects that fit together or can be stored efficiently in close proximity to each other. Although the combined dispenser 204 is depicted immediately adjacent and/or above the support 202, these two features can physically interact with each other such that the support 202 physically touches and structurally holds the combined dispenser 204 (e.g., in a manner that is generally erect or generally perpendicular). The first dispenser 208 can be configured for dispensing a liquid sanitizer, and a second dispenser 210 can be configured for dispensing a solid cleaning product such as a paper-based product. In some embodiments, multiple cleaning products in different states of matter can be stored and dispensed together by the same system and can be conveniently provided to a user, such that one hand of the user easily obtains one product while the other hand of the user easily obtains the other product. Different cleaning products can be dispensed to the same user simultaneously and conveniently.

Figure 3:
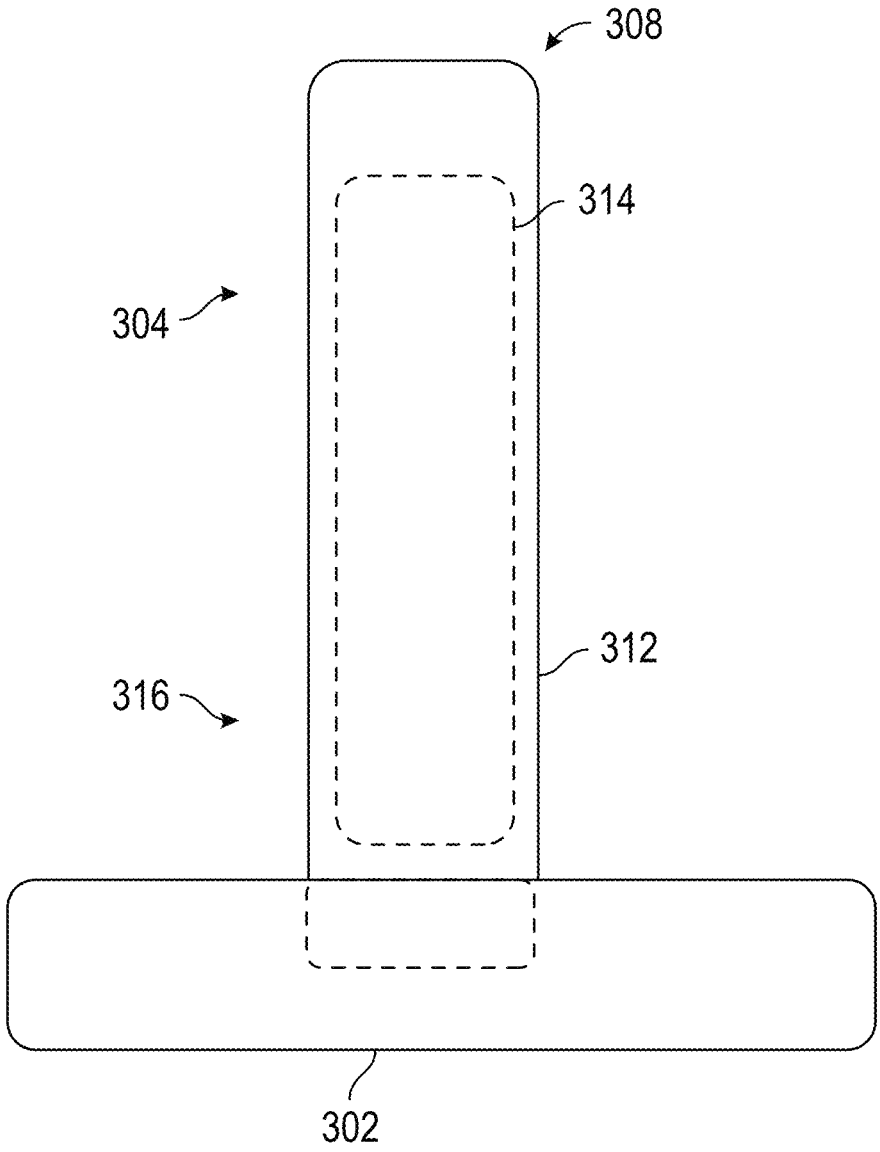
FIG. 3 illustrates a system for supporting a structure and an internal receptacle.

FIG. 3 shows an example embodiment of FIG. 1. One or more of the features of FIG. 3 can be used within or instead of the features of any embodiment in this specification. A primary support 302 provides a structure into or onto which the combined dispensers can be placed. A structural interaction zone 316 can allow the combined dispenser 304 to physically touch the primary support 302. For example, if a combined dispenser 304 is generally in the shape of an elongate rod, a primary support 302 can provide a slightly wider hollow rod into which the combined dispenser 304 can be inserted, or it can provide a generally right cylindrical opening into which the combined dispenser 304 can be inserted. A structural interaction zone 316 can comprise a lower portion of a rod-shaped structure and a hollow or otherwise supporting portion of a primary support 302. The structural interaction zone 316 can include a variety releasable attachments for the combined dispenser 304. For example, a releasable attachment can releasably attach the primary support 302 to the dispenser 304. Various approaches to connection can be employed, including one or more threaded connections, friction fits, snap fits, latches, nesting, magnets, twist-lock, bayonet attachment, spring-loaded pressure fits, etc.

FIG. 3 also shows that a combined dispenser 304 can comprise a dispenser 308, an external storage and dispenser 312, and an internal receptacle 314. An internal receptacle 314, depicted here with dashed lines within the combined dispenser 304, can be particularly useful for liquid cleaning substances. For example, a liquid sanitizer can be stored within such a component that may comprise a reservoir inside an elongate structure. A dispenser 308 can be located toward the top of a combined dispenser 304 and an external storage and dispenser 312 can be located toward the bottom of a combined dispenser 304. FIG. 3 also shows how one dispenser can comprise internal storage while another dispenser and comprise external support. This is especially useful if one cleaning substance is a liquid and the other cleaning substance is a solid such as a roll of paper products. The present disclosure recognizes that an interior space within a roll of paper products can be efficiently utilized to position a liquid cleaning product, since liquid and paper cleaning products can be used together. They can be stored in a highly efficient and elegant manner such that a user can access both of them simultaneously and/or return either or both of them to their storage positions quickly and easily, one with each hand. The same primary support 302 can be used to store and provide access to multiple types of cleaning products in this matter, minimizing required shelf or counter space in a kitchen, laboratory, bathroom, workshop, or other cleanable area.

Figure 4:
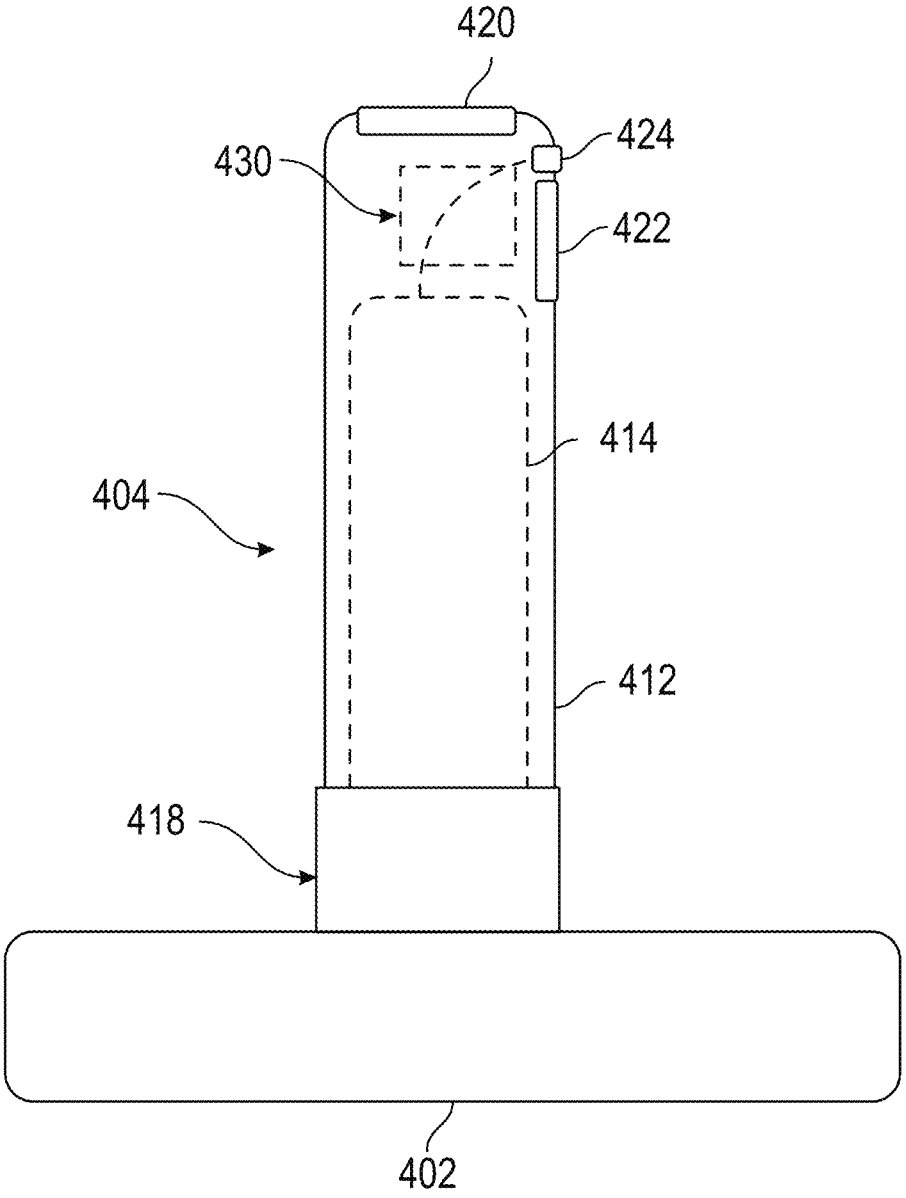
FIG. 4 illustrates a system that can be used to store and dispense both paper towels and liquid cleaning agent.

FIG. 4 shows an example embodiment of FIG. 1. One or more of the features of FIG. 4 can be used within or instead of the features of any embodiment in this specification. FIG. 4 depicts a base 402. On the base 402 a rod holder 418 is depicted as a generally hollow rod extending upward from the base 402. Into the rod holder 418 is inserted a tube support rod 412. The tube support rod 412 has within it a liquid storage reservoir 414 depicted with dashed lines. Extending from the top of the liquid storage reservoir 414 is a schematically depicted passage leading to a nozzle 424. A spray trigger 422 can interact with pump mechanics 430 to cause liquid stored in the reservoir to pass up to and out of the nozzle 424. The tube support rod 412 and one or more of the other features described to handle liquid together can form a combined dispenser 404. In some embodiments, both internal and external storage is provided. Internal storage is provided by the liquid storage reservoir 414 and external storage is provided by a surface of the base facing upward, as well as by the combination of the rod holder 418 and the tube support rod 412. In some embodiments, the rod holder 418 can extend along more of the length of the tube support rod 412, such that the tube support function is actually performed mostly or entirely by the rod holder 418.

In FIG. 4, the rod holder 418 can perform one or more functions of the structural interaction zone 316 in FIG. 3. The tube support rod can perform one or more functions of the external storage and dispenser 312 of FIG. 3 and the second dispenser 210 of FIG. 2, for example. Moreover, the liquid storage reservoir 414 can provide one or more functions of the internal receptacle 314 of FIG. 3. The spray trigger 422, the nozzle 424, and the pump mechanics 430, can all provide one or more of the functions and structures of the dispenser 308 of FIG. 3. The combined dispenser 404 can perform one or more of the functions of the combined dispenser 304 shown in FIG. 3, and the combined dispenser 204 of FIG. 2.

The base 402 can be weighted to prevent or to resist tipping. If electronic components are included, the base can provide space for one or more batteries, charging units, transformers, and other electrical features. Such features can interact with other system components such as a dispenser. A base can include a charging unit, and a dispenser can include at least one rechargeable battery that interacts with the recharging unit to increase its charge. The battery can power a motorized sprayer for dispensing liquid material from the dispenser (which can be a sprayer). The trigger can comprise an electrical actuator for actuating the motorized sprayer. One or more portions of the system (e.g., a base or dispenser) can also receive electrical power from a local or remote electrical plug and/or solar panel, for example. Electrical connections can be provided in, through, and/or in conjunction with a holder, latch, or other support structure (e.g., the rod holder 418). Insertion of a dispenser into a rod holder 418 can both physically and electrically support the dispenser. Electrical conducting and/or charging leads can be applied between the base and a dispenser when they are releasably joined, allowing electrical current to pass between them, thereby powering and/or recharging one or more electrical features.

A dispenser can comprise a sprayer sized to fit at least partially within a standard paper towel roll. For example, the dispenser can comprise an elongate portion in the shape of a cylinder that can have a diameter or cross-sectional area that is at least about 1 inch (e.g., about 1.5 inches) and/or can have a length that is at least about 10 inches (e.g., about 11 inches). A rod holder 418 may also fit within that same space. The dispenser may be held, removably secured by, insertable, and/or nested within the rod holder 418. The sprayer can maximize, optimize, or provide an advantageously sufficient interior reservoir volume within that space. A sprayer's shape can conform to or be compatible with such a cylindrical space to facilitate insertion into and withdrawal from that space, while providing a relatively large amount of liquid storage in a refillable reservoir. The sprayer can be generously sized to store enough liquid to provide for multiple uses and reduce frequency of refills. The sprayer can be configured to hold or contain, for example, at least about 8 fluid ounces and/or less than or equal to about 11 fluid ounces.

The spray trigger 422 can have a low profile and be formed to protrude only slightly if at all from the generally rod-like structure of a combined dispenser 404. A nozzle 424 can protrude only slightly, if it all, from the generally rod-like structure of a combined dispenser 404, thereby allowing the overall structure of a combined dispenser 404 to fit within a generally confined space such as would be available within the interior of a standard paper towel roll. In some embodiments, no spray trigger is provided and a combined dispenser 404 can be squeezable such that pressure to spray a fluid from an internal liquid storage reservoir 414 is provided by a user's hand squeezing the outside of the dispenser 404 such that liquid can flow out of a nozzle 424. In some embodiments, the pump 430 is not located at a specific position adjacent a liquid storage reservoir 414. Rather, the pump is inherent in the resilient structure of the combined dispenser 404 itself. A squeeze bottle approach may incorporate flexible or elastomeric, plasticized or rubberized, sidewalls that surround at least a portion of the liquid storage reservoir 414 and can comprise or be inserted within a tube support rod 412. In some embodiments, a spray trigger 422 does not provide the full mechanical force required to pump liquid from a liquid storage with over 414 out in nozzle 424. A force may be provided by pump components, which may include a motorized pump. In such an arrangement, the spray trigger 422 can be used to actuate the motorized pump contained within the pump 430. A battery can be included within the system (e.g., a rechargeable battery) to power the motorized pump. An electrical connection can be provided between the spray trigger 422 and the pump 430.

Various approaches for holding, supporting, or securing a dispenser (e.g., a sprayer) can be employed. Some of these can include a latching function. Some can be passive and/or can include non-articulating structures. A release of a dispenser can comprise a surface that allows a user to grip and lift, twist, or otherwise separate the dispenser from a base 402, a rod holder 418, or other holding structure. Twisting can release a threaded component. Sliding can release a nested or friction-fit component. Decoupling can release a latch or snap. Lifting can release a magnetic holder. Pushing and twisting can release a bayonet mount or spring-loaded pressure fit, etc.

FIG. 4 depicts a release 420, positioned in this illustration at the top of the combined dispenser 404. A release 420 can be actuated by a user to facilitate removal of a combined dispenser 404 from a base 402. A sprayer may be inserted within a rod holder 418 that is much taller than the shorter version depicted in this figure. A release 420 can allow a sprayer to release from the system. For example, a release 420 can apply a pressure on a physical spring, latch, actuating rod, string, or other mechanism causing the combined dispenser 404 to disengage from one or both of the rod holder 418 and the base 402. For example, a latch system can engage between a combined dispense and structure 404 and a rod holder 418 and/or base 420 on insertion of the combined dispenser 404 into the rod holder 418. A latch system can be disengaged when a user applies pressure on a button toward the top of the combined dispenser 404. A release 420 can comprise a button that in turn pushes on a spring, thereby releasing a catch that otherwise secures the combined dispenser 404 into place. In some embodiments, a dispenser 404 can be inserted into a rod holder 418 and be held in place without a latch. If a rod holder 418 is sized to snugly receive a dispenser 404, that snug fit can provide sufficient support and avoid rattling or wobbling of the dispenser 404. In some embodiments, a rod-shaped dispenser 404 can have external threads or snaps provided that interact with corresponding thread or snap structures in a rod holder 418. One or more interactive features can be released in various ways including by pulling, unscrewing, squeezing on cantilevered components, pushing, pulling, or extracting in another manner.

Figure 5A:
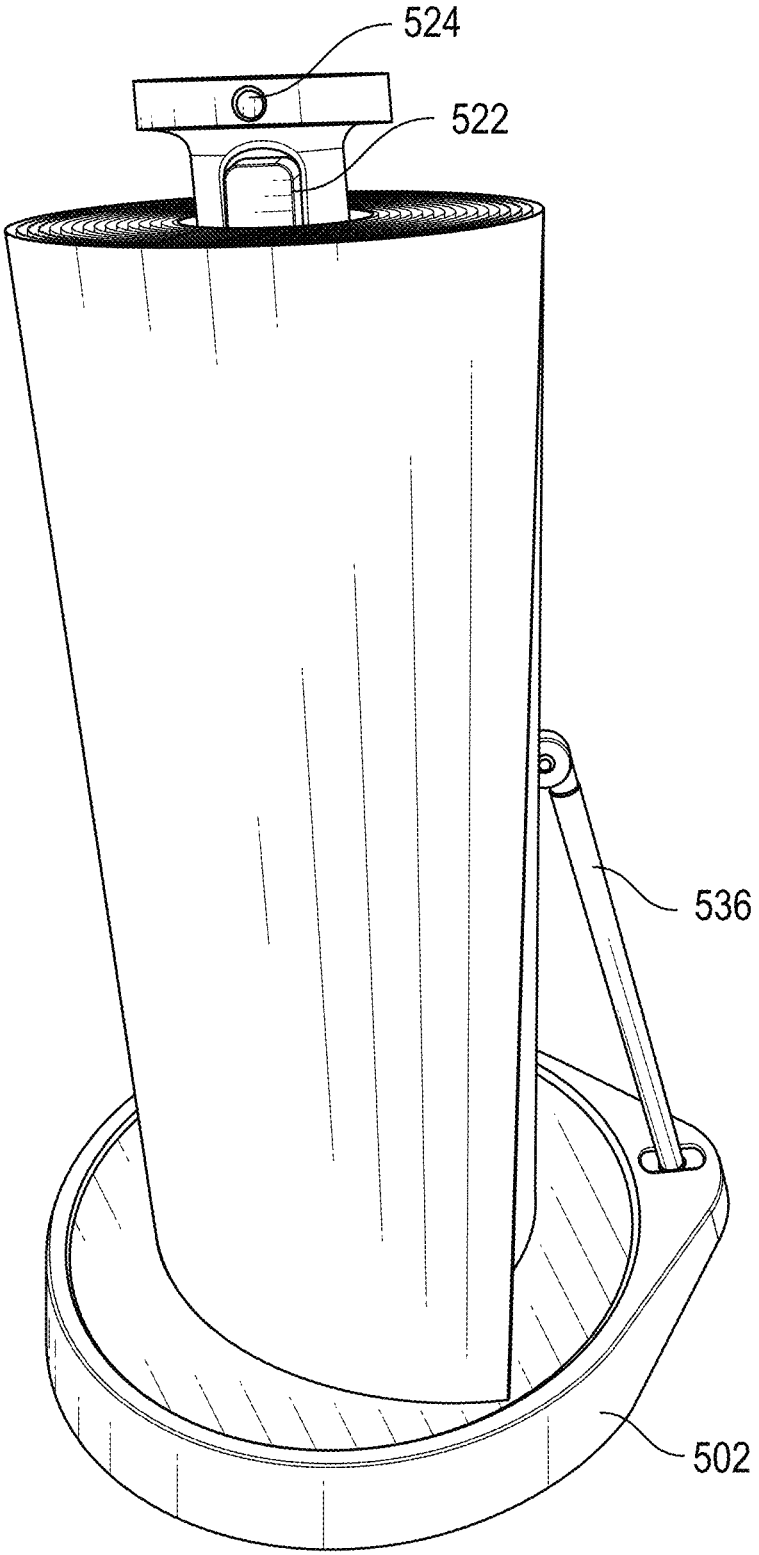
FIG. 5A shows a prototype system for dispensing paper towels and cleaning fluid.

FIG. 5A shows an example of a liquid and paper towel dispensing system. In FIG. 5A, a base 502 is shown with a raised lip around a perimeter thereof. This raised lip can be sized and configured to correspond to the outer edge of a full roll of paper towels, for example. The lip can indicate to a user where to position and hold a roll of paper towels, and it can also indicate how full a particular role may be with a quick visual inspection. A large distance between the outer paper towel and the lip and indicate that a paper towel refill is more likely to occur in the near future. An elongate, inwardly biased, friction-inducing component 536 is shown protruding from the base 502 and tipped to exert a slight pressure against a roll of paper towels to resist rolling or rotation of the roll of paper towels with respect to the sprayer. Protruding from the roll of paper towels at the top of FIG. 5A is shown a structure having a spray trigger 522 and a nozzle 524. The spray trigger 522 can provide one or more of any of the functions and/or benefits with respect to spray trigger 422 of FIG. 4 and/or any other embodiment. The nozzle 524 can provide one or more of the functions and/or benefits of nozzle 424 of FIG. 4. In this figure, a dispenser is shown protruding slightly from the top of the role of paper towels. The dispenser can dispense liquid cleaning agent and/or can also form or be nested within a structure that facilitates dispensing of paper towels from the roll as shown here.

Figure 5B:
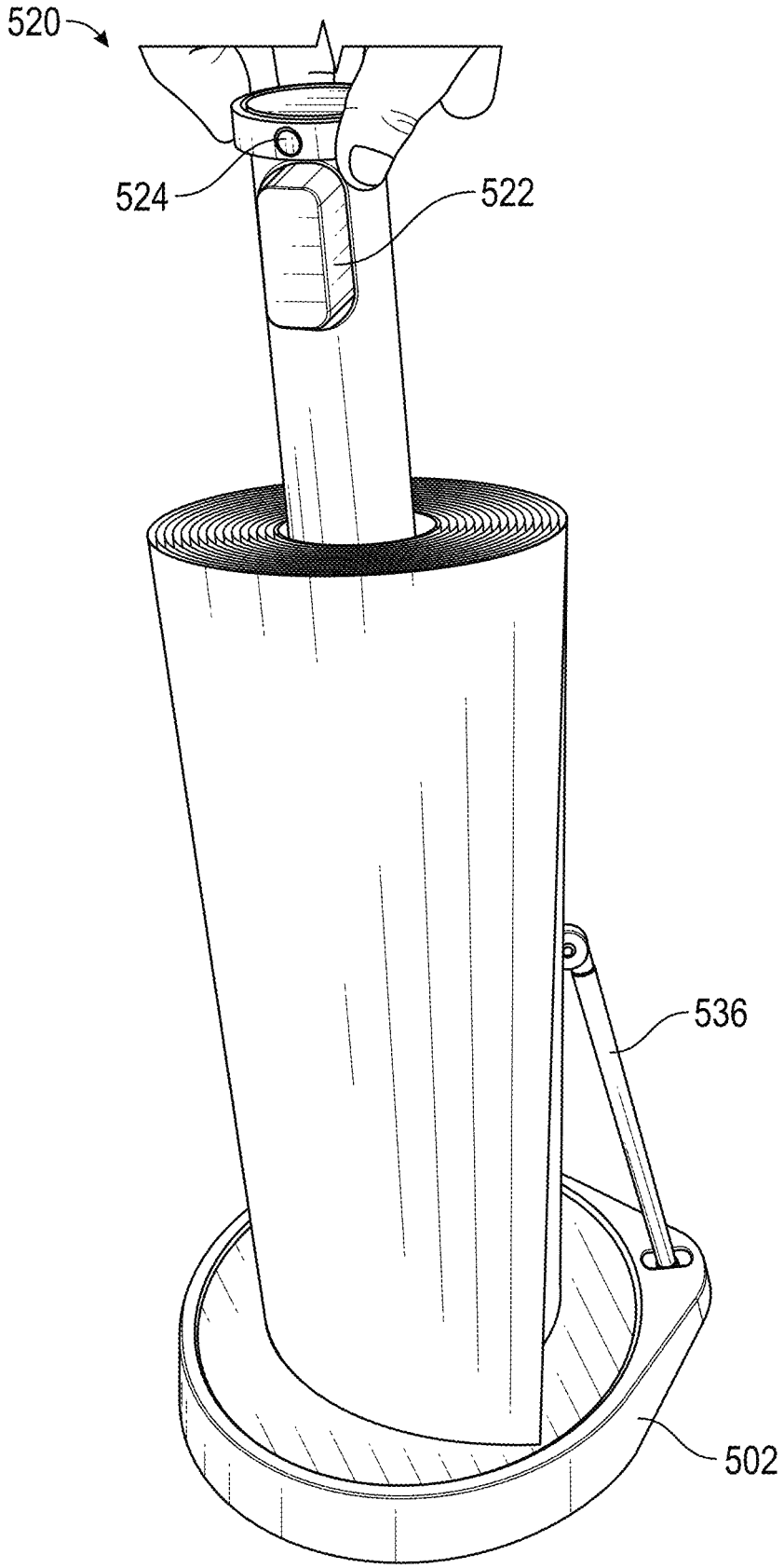
FIG. 5B shows a fluid dispenser being lifted up.

FIG. 5B shows the dispensing system of FIG. 5A, with a user grasping and pulling upward on a portion of the system (e.g., a dispenser that can comprise a sprayer, for example). The base 502 and the friction feature 536 are both still in place. However, a larger portion of the spray trigger 522 is now visible because a sprayer is being withdrawn upward and removed from the central axis of a roll of paper towels. A nozzle 524 is visible pointing in the same direction of the spray trigger 522. A release 520 can be provided at the top of the sprayer. This release can communicate electronically or physically with a spring, latch, magnet, or other mechanism configured to disengage or otherwise separate a dispenser from the base 502.

FIGS. 5A and 5B both depict a widened, protruding head portion for a sprayer that can provide a convenient grasping surface allowing a user to pull a sprayer upward in a convenient manner. This widened portion can also serve to retain paper towels in place if the system tips over. If a latching or other holding function is sufficiently strong, the widened portion can also provide a grip or handle (which can instead have a different gripping shape) for lifting, carrying, or moving the entire system. The widened portion can also allow for a twisting motion even when the thinner remainder of the removable dispenser is inaccessibly disposed within a paper towel roll. When a sprayer is functioning as a sprayer, the widened portion can provide a ledge that helps support the sprayer in a user's hand, resting atop a curved index finger as it sprays and carries the device.

A dispenser can include one or more grip-facilitating surfaces, for example at or near the top of such a structure. These surfaces can be configured for increased traction, and/or user comfort and satisfaction. For example, a stainless steel surface can have a clean and smooth appearance. A soft grip can be provided where a user's hand grips a sprayer, the grip comprising a rubberized, elastomeric cushioned surface. The surface can be an elastomeric, resilient, non-slip, and/or easily cleanable material. A trigger can be formed from plastic, rubber, or other materials configured for comfort and efficiency of a trigger finger.

Figure 6:
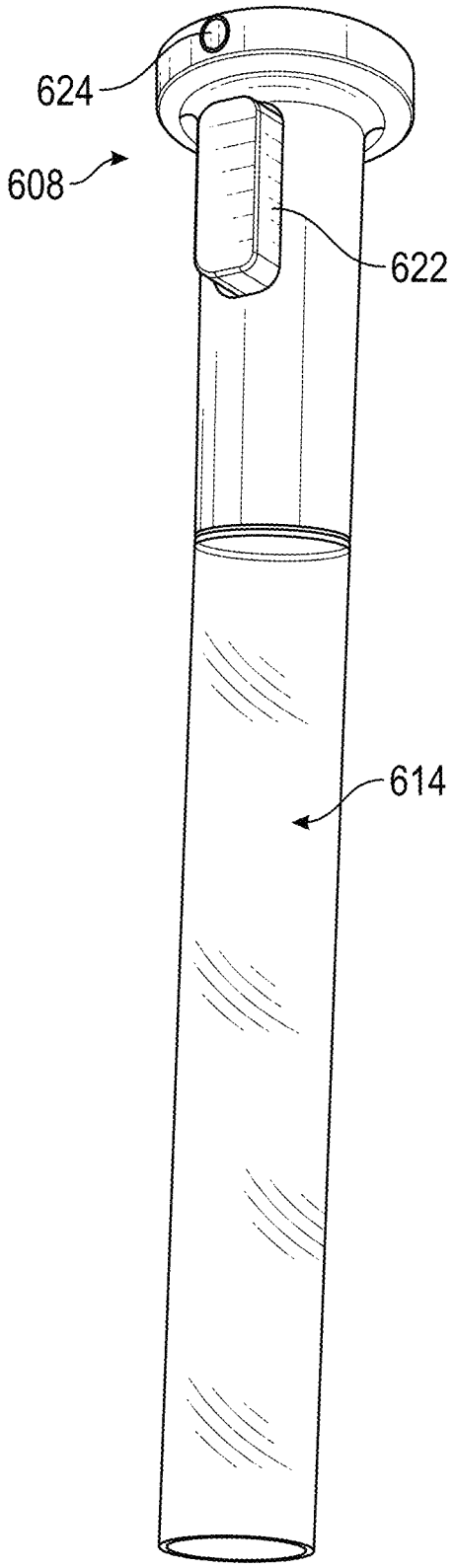
FIG. 6 shows a fluid dispenser prototype with a viewable reservoir.

FIG. 6 shows a liquid dispenser 608 that can perform one or more of the functions of the sprayer of FIGS. 5A and 5B. The liquid dispenser 608 can have a liquid storage reservoir 614, a spray trigger 622, and a nozzle 624. The liquid storage reservoir can have a clear or otherwise revealing wall structure, allowing a user to easily see how much liquid is remaining within the reservoir 614 and upper portion of the liquid dispenser 608 can be formed from metal or another convenient material for cleaning and grasping. Stainless steel provides a clean look and is practical because it avoids staining and can be cleaned readily. An upper portion of a liquid dispenser 608 can be joined to a lower portion of a liquid dispenser 608 by gluing, screwing, snap fit, heat assisted fusion, or other manufacturing methods. A tube that can form the liquid storage reservoir 614 as depicted here can be formed from extruding, rolling, or any other manufacturing methods. A stainless steel spray portion can be formed from extrusion, rolling, molding, or other manufacturing methods. FIG. 6 shows a product having a brushed metal surface toward the top and a polished plastic surface toward the bottom. Polishing, brushing, painting, smoothing, or other finishing approaches can be used.

Figure 7:
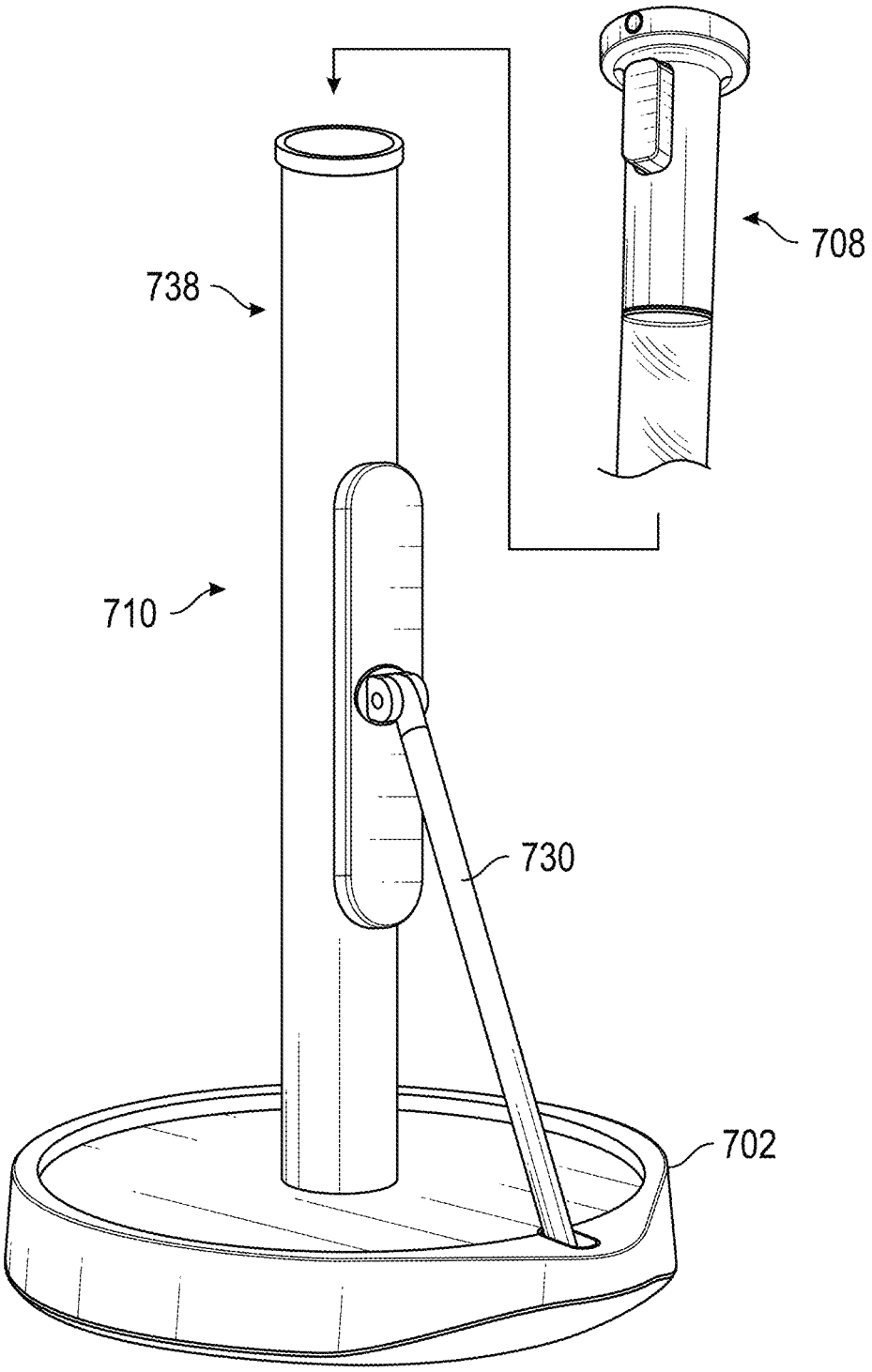
FIG. 7 shows how a liquid dispenser can be supported and stored.

FIG. 7 shows a structure without any paper towels present. A liquid dispenser 708 can include one or more structures or functions of FIG. 6 or any other embodiment. The entire structure is not shown. The liquid dispenser 708 can comprise any elongate tube that is sized to fit within a liquid dispenser holder 738. The liquid dispenser holder 738 can play a dual role as a solid dispenser 710. The solid being dispensed can in some cases comprise paper towels, for example. A friction feature 730 is shown extending up from a base 702 and resting against the solid dispenser 710. As shown here, and upper rim of a liquid dispenser holder 738 can have a surface configured to smoothly hold and interact with a portion of a liquid dispenser 708. For example, when a liquid dispenser 708 is inserted within a liquid dispenser holder 738, it can be received with a pressure fit when it nests fully within the hollow tube of the liquid dispenser holder 738.

Figure 8A:
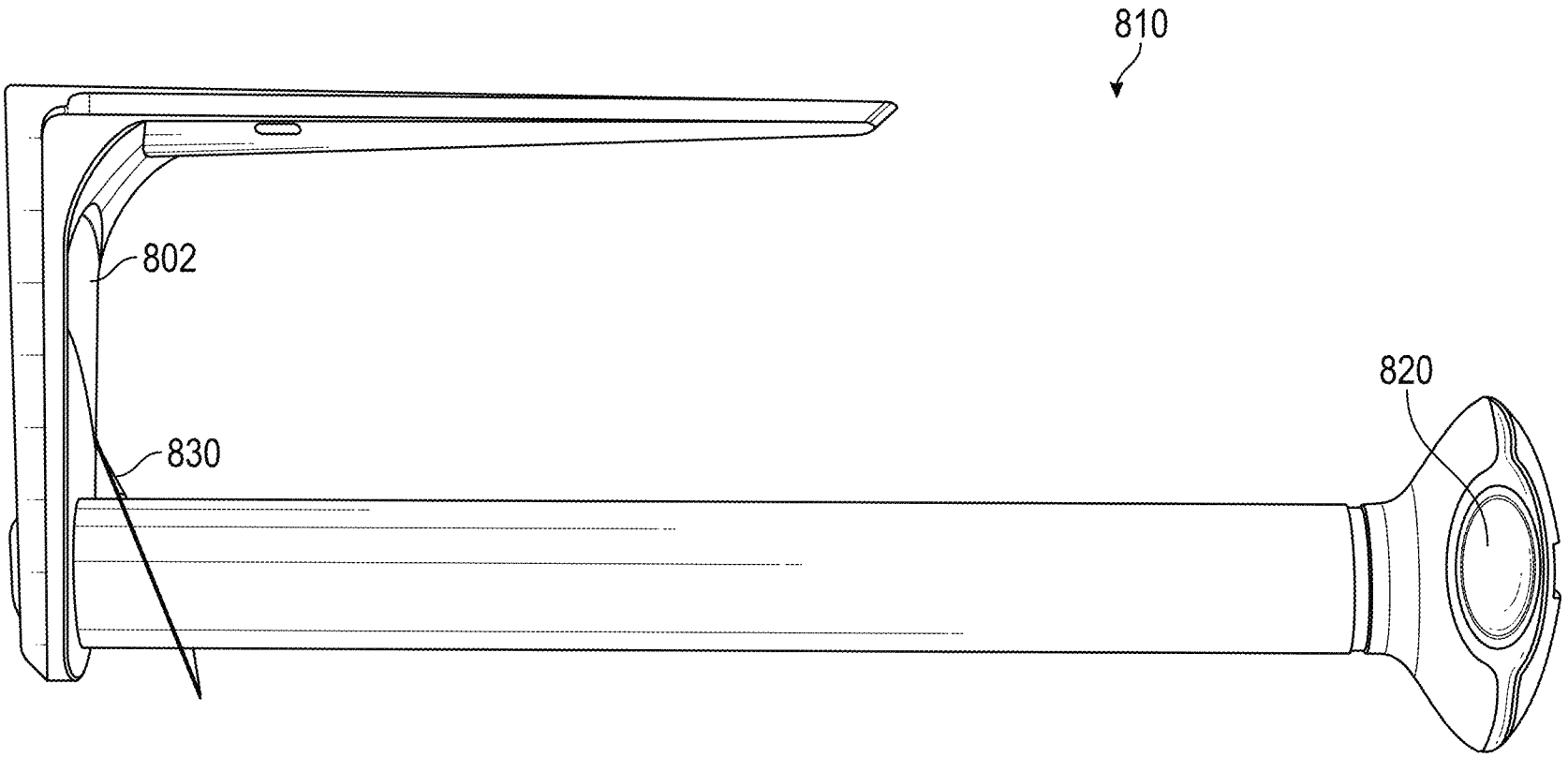
FIG. 8A shows an alternative orientation of a structure for dispensing cleaning materials.

FIG. 8A shows another system for a paper dispenser 810. This structure is configured for mounting horizontally, for example underneath a kitchen cabinet. The base 802 is located to the side rather than below the support component. FIG. 8A shows a friction feature 830 that can interact with a paper towel holder, for example. The friction feature 830 can exert the force against a paper towel roll or the paper towels themselves thereby preventing the roll from turning too quickly, and allowing a user to pull paper towels from the roll with a single hand rather than holding the roll with the other hand at the same time. In this figure a release 820 is shown at the right, allowing a user's thumb to press in and remove the horizontal rod structure from the solid dispenser 810. This can facilitate refilling the paper towel holder with a new roll of paper towels. The features and benefits of any embodiment of a liquid dispenser can also be applied to this embodiment. For example, the horizontal rod of FIG. 8*a* can support or comprise a liquid reservoir, and the structures shown at the right containing the release 820 can be modified to include a spray function, including a trigger and a nozzle, for example. Any elongate structure configured to hold a paper towel roll can also be modified to contain, support, store, and/or dispense liquid sanitizing agents.

Figure 8B:
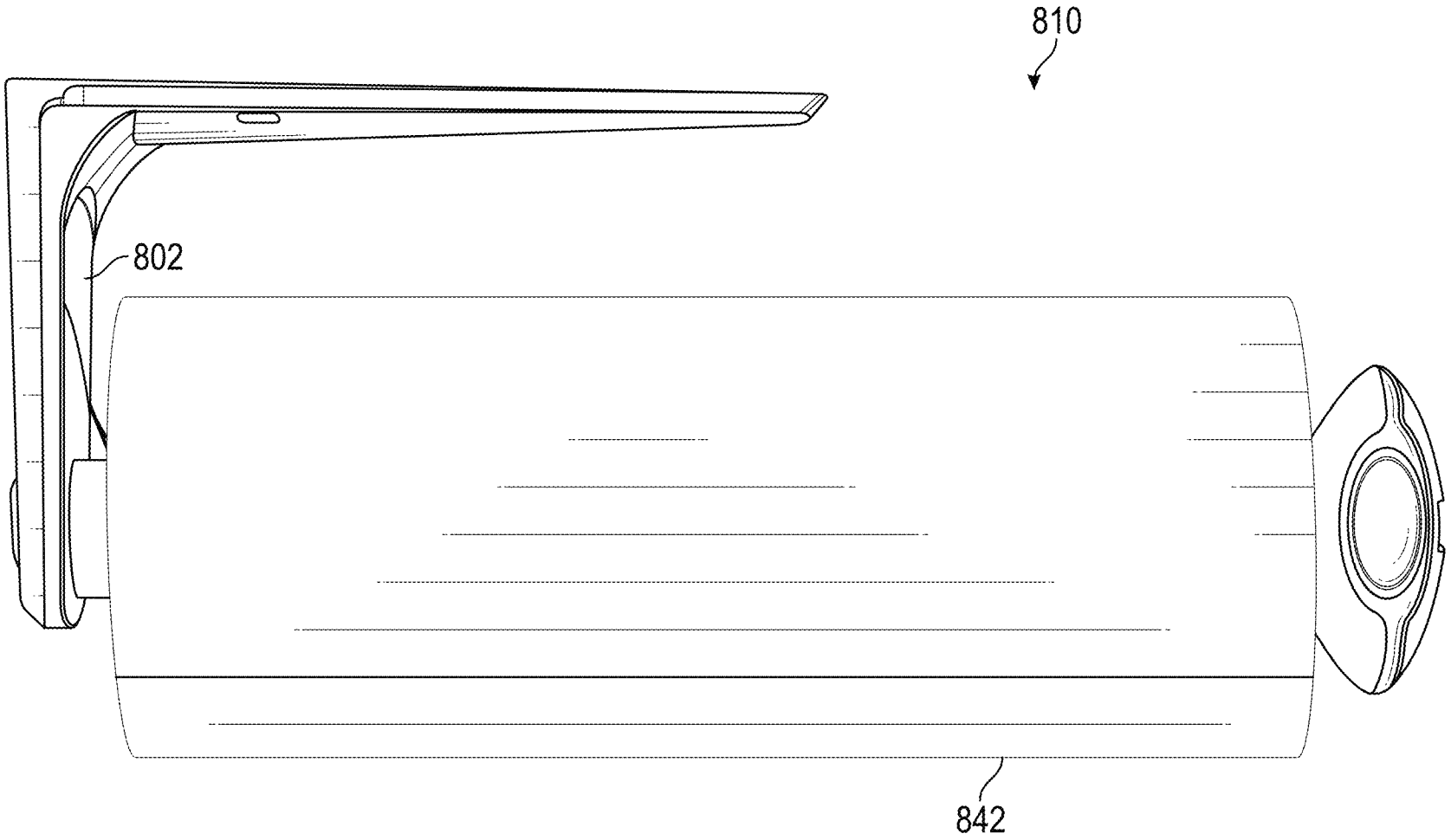
FIG. 8B shows the structure of FIG. 8 with a paper towel roll in place.

FIG. 8B shows the structure depicted in FIG. 8A, including the base 802. The solid dispenser 810 is depicted in this view as holding a paper towel roll 842.

Figure 9:
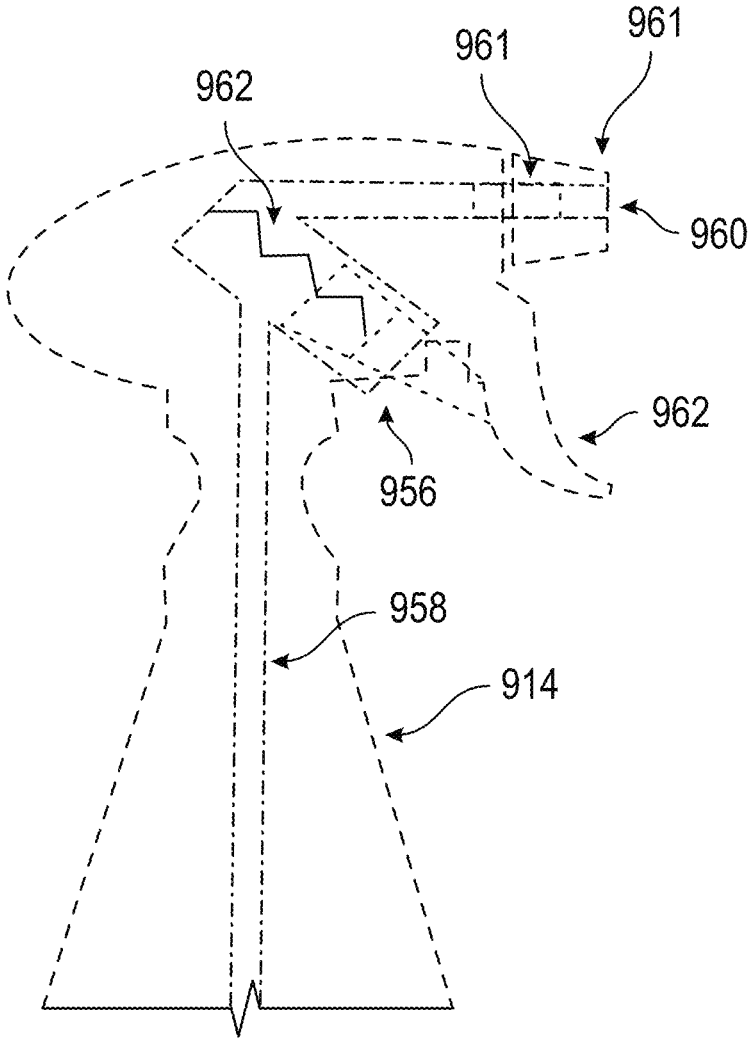
FIG. 9 provides an example of pump mechanics.

FIG. 9 provides an example of pump mechanics 430 (see FIG. 4) in the context of a spray bottle that can be used in any embodiment and/or that can be modified in any suitable way for use in any embodiment, whether manual or motorized. Hand actuated mechanical pump 956 can draw fluid up a connected straw 958 and force the fluid through an orifice 960 creating a stream of fluid. This stream of fluid can be modified in a number of dispenser configurations by a variable pitch nozzle 961 that changes the fluid stream into a mist. Pump 956 typically is a piston style displacement pump with a spring return pump handle 962. Each time the spray handle 962 is compressed, the volume of fluid is driven out of the pump 956 to the orifice 960 which creates the stream of fluid drawn from the straw and a similar quantity of fluid is drawn up into the pump 956 through the straw 958 on the return stroke of the pump handle 962. A check valve 964 blocks the backward flow of fluid from the orifice 960 allowing the return stroke of the pump handle 962 to draw up more fluid from the reservoir 914. Pump handle 962 is repeatedly actuated by the user until a sufficient quantity of fluid is dispensed. The assembly described here can be modified to fit within the elongate sprayer described herein for inserting in a paper towel roll, or in any other suitable way. For example, the handle can be shortened, the angle of the spring can be changed, and the volume and shape of internal passages can be adjusted. One or more of the components can be used and/or modified to be attached to a motor to enable motorized dispensing of fluid.

Additional or alternative structures and approaches to electromechanical pump mechanics 430 are provided in: U.S. Pat. Nos. 7,556,179; 8,096,445; 10,076,216; and 10,806,305. The entire disclosure of each of these patents is hereby fully incorporated by reference into the present specification, for all purposes. For example, some of the examples described in these documents can convey fluid from an internal reservoir using an electrical pump. These or similar mechanisms can be incorporated into a spray bottle of an elongate shape with one or more of the features described in this specification. In some embodiments, a dispenser such as those described in the referenced patents can be modified to also dispense or store paper cleaning products such as paper towels. A spout or nozzle of a soap dispenser can extend over the top of a roll of paper towels so that sanitizer or soap is dispensed beyond the edge of the roll, and a user can quickly grasp paper towels shortly after dispensing the fluid material.

The following is claimed:

1. A dispensing system configured to dispense both liquid and paper towels, the dispensing system comprising:

a base with an upper surface comprising an area sufficiently wide to be configured to support a standard paper towel roll;

a liquid dispenser comprising a sprayer and an elongate receptacle configured to hold a liquid cleaning material, the liquid dispenser having an axial length and a maximum horizontal width, the maximum horizontal width of the liquid dispenser being sufficiently small to be configured to fit within the standard paper towel roll; and a holder configured to removably attach the elongate receptacle to the base, the holder comprising a releasable attachment with a spring or latch configured to accept a pushing force to separate the liquid dispenser from the holder.

2. A combination of the dispensing system of claim 1 and the standard paper towel roll.

3. The dispensing system of claim 1, wherein the holder comprises a hollow supporting tube.

4. The dispensing system of claim 3, wherein the holder is elongate.

5. The dispensing system of claim 4, wherein the holder is configured to removably receive a majority of the elongate receptacle.

6. The dispensing system of claim 1, wherein the dispensing system comprises an upper handle.

7. The dispensing system of claim 1, wherein the elongate receptacle comprises a transparent portion configured to allow viewing of a filled state of a reservoir.

8. The dispensing system of claim 1, wherein the elongate receptacle further comprises a catch for securing the elongate receptacle to the base, and the base comprises a one-handed release configured to disengage the catch to allow a user to remove the elongate receptacle for use.

9. A dispensing system configured to dispense both liquid and paper towels, the dispensing system comprising:

a base with an upper surface comprising an area sufficiently wide to be configured to support a standard paper towel roll;

a liquid dispenser comprising a sprayer, an elongate receptacle, and a handle positioned above the sprayer, the liquid dispenser being configured to hold a liquid cleaning material, the liquid dispenser having an axial length and a maximum horizontal width, the maximum horizontal width of the liquid dispenser being sufficiently small to be configured to fit within the standard paper towel roll; and a holder configured to removably attach the elongate receptacle to the base, the holder comprising a releasable attachment with a spring or latch;

wherein the handle is configured to permit a user to lift and carry the dispensing system when the liquid dispenser is attached to the base.

10. A combination of the dispensing system of claim 9 and the standard paper towel roll.

11. The dispensing system of claim 9, wherein the holder comprises a hollow supporting tube.

12. The dispensing system of claim 11, wherein the holder is elongate.

13. The dispensing system of claim 12, wherein the holder is configured to removably receive a majority of the elongate receptacle.

14. The dispensing system of claim 9, wherein the elongate receptacle comprises a transparent portion configured to allow viewing of a filled state of a reservoir.

15. The dispensing system of claim 9, wherein the elongate receptacle further comprises a catch for securing the elongate receptacle to the base, and the base comprises a one-handed release configured to disengage the catch to allow a user to remove the elongate receptacle for use.

16. A portable dispensing system configured to dispense both liquid and paper towels, the dispensing system comprising:

a base with an upper surface comprising an area sufficiently wide to be configured to vertically support a standard paper towel roll, the base being sufficiently heavy to resist tipping of the portable dispensing system when contacted by external forces commonly encountered in kitchen or other household counter-top situations;

a liquid dispenser comprising a sprayer and an elongate receptacle, the liquid dispenser being configured to hold a liquid cleaning material, the liquid dispenser having an axial length and a maximum horizontal width, the maximum horizontal width of the liquid dispenser being sufficiently small to be configured to fit within the standard paper towel roll; and a handle located in an upper region of the dispensing system.

17. A combination of the dispensing system of claim 16 and the standard paper towel roll.

18. The dispensing system of claim 16 wherein the handle is configured to permit lifting and carrying the entire portable dispensing system.

19. The dispensing system of claim 16 further comprising a holder configured to removably attach the elongate receptacle to the base, the holder comprising a releasable attachment with a spring or latch.

20. The dispensing system of claim 16 further comprising a holder for receiving the liquid dispenser, the holder comprising an elongate tube.

21. The dispensing system of claim 18 wherein the handle is part of the liquid dispenser.

* * * * *